US005472147A

United States Patent [19]

Doppstadt

[11] Patent Number: 5,472,147

[45] Date of Patent: Dec. 5, 1995

[54] COMMINUTING MACHINE WITH COMMINUTION GRATES

[76] Inventor: Werner Doppstadt, Vossnacker Strasse 67, 42555 Velbert, Germany

[21] Appl. No.: 215,521

[22] Filed: Mar. 22, 1994

[30] Foreign Application Priority Data

Apr. 7, 1993 [DE] Germany ..... 43 11 435.0

[51] Int. Cl.[6] ..... B02C 19/20; B02C 13/282; B02C 13/284

[52] U.S. Cl. ..... 241/88.4; 241/89; 241/89.1; 241/89.2; 241/101.74; 241/160; 241/189.1; 241/285.3

[58] Field of Search ..... 241/73, 86.1, 86.2, 241/88.1, 88.2, 88.3, 88.4, 89, 89.1, 89.2, 101.7, 160, 189.1, 285.2, 285.3, 287, 300.1

[56] References Cited

U.S. PATENT DOCUMENTS

| | | | |
|---|---|---|---|
| 842,430 | 1/1907 | Simpson | 241/89.1 X |
| 1,085,692 | 2/1914 | Liggett | 241/86 X |
| 1,125,137 | 1/1915 | Liggett . | |
| 1,355,335 | 10/1920 | Hasendahl | 241/88.4 |
| 1,405,952 | 2/1922 | Stuart | 241/101.7 |
| 1,439,754 | 12/1922 | Plarsted | 241/88.1 |
| 1,872,223 | 8/1932 | Borton | 241/189.1 |
| 2,076,025 | 4/1937 | Hazle, Jr. | 241/89.2 |
| 2,268,860 | 1/1942 | Edens et al. | 241/88.4 X |
| 3,630,458 | 12/1971 | Smiley | 241/189.1 X |
| 4,226,375 | 10/1980 | Cameron . | |
| 4,852,816 | 8/1989 | Doppstadt . | |

FOREIGN PATENT DOCUMENTS

| | | |
|---|---|---|
| 212194 | 7/1986 | European Pat. Off. . |
| 2902257 | 7/1980 | Germany . |
| 1230678 | 5/1986 | U.S.S.R. . |

*Primary Examiner*—Timothy V. Eley
*Attorney, Agent, or Firm*—Collard & Roe

[57] ABSTRACT

The comminuting machine includes a housing provided with a rotary impact mechanism. A conveyor conveys infed material to the rotary impact mechanism which cooperates with an impact plate in disintegrating the infed material. A first comminuting grate follows the impact plate in the rotary direction and is arranged laterally of the rotary impact mechanism. A second comminuting grate is arranged below thereof. Both comminuting grates constitute arcuate plates with throughpass openings and cooperate with the rotary impact mechanism in forcing the infed material through grate openings with further comminution. Adjusting devices are associated with the comminuting grates for adjusting the same relative to the rotary impact mechanism.

33 Claims, 9 Drawing Sheets

COMMINUTING MACHINE WITH COMMINUTION GRATES

CROSS-REFERENCE TO RELATED APPLICATION

This application is related to my copending U.S. patent applications Ser. No. 08/215,326, filed Mar. 21, 1994, and entitled "Mobile Material Processing Machine With Tandem Axle", Ser. No. 08/215,523, filed Mar. 22, 1994, entitled "Arcuate Impact Plate and Comminuting Machine With Arcuate Impact Plate", Ser. No. 08/217,388, filed Mar. 24, 1994, entitled "Comminuting Machine With Comminution Cover Plate", and Ser. No. 08/217,377, filed Mar. 24, 1994, entitled "Comminuting machine With Comb-like Further Comminuting Structure", and Ser. No. 08/217,372, filed Mar. 24, 1994, and entitled "Infeed Construction for Comminuting Machine".

BACKGROUND OF THE INVENTION

The present invention relates to a new and improved construction of a comminuting machine.

In its more particular aspects, the present invention specifically relates to a new and improved construction of a comminuting machine for comminuting waste and, more particularly, waste wood material intended to be composted. Generally, such machines are mounted at a mobile support frame and comprise a housing in the form of a container for receiving the material to be comminuted. A conveyor is disposed in the housing or container for conveying the infed material to a rotary impact mechanism. The rotary impact mechanism cooperates with an impact plate in a comminuting section which precedes a discharge opening of the housing or container for discharging the comminuted material under the action of the rotary impact mechanism. The impact plate may be followed by further comminuting means through which the comminuted material is discharged with further comminution. The comminuted material may be deposited in stacks or pits for composting.

A comminuting machine or composting equipment such as known, for example, from U.S. Pat. No. 4,852,816, granted on Aug. 1, 1989, to the applicant of the instant application, is constructed for comminuting organic or wood waste originating in forestry, municipality or building operations. A trough-shaped container receives the material to be comminuted, for example, by means of a shovel loader. Infeed means are provided in the form of an infeed conveyor which is located above the bottom of the container and feeds the material to a rotary impact mechanism which drives the infed material through an entrance gap defined between an impact ledge and rotating flails of the rotary impact mechanism. The impact ledge is followed by retainer claws which extend between adjacent ones of the rotating flails for comminuting the material which has been forced through the entrance gap. An impact plate follows the retainer claws and has teeth protruding toward the rotating flails and cooperating therewith for further comminuting the material prior to its discharge through a discharge opening from a rear part of the container.

In a further development (Doppstadt shredder, type AK 330) of the aforementioned comminuting machine the infeed means further include an intake roll which bears upon the infed material from above. The entrance gap is followed by an impact plate containing two plate sections. The two plate sections are arranged at an angle with respect to each other so that the impact plate extends along an upper part of the cylindrical action area of the rotating flails. Teeth protrude from the impact plate toward the rotating flails and are arranged in parallel rows transverse with respect to the rotational direction of the rotating flails, the rows of teeth being transversely offset from each other. There is thus defined a throughpass gap through which the incoming material is forced under the action of the rotating flails and subjected to comminuting action. The impact plate may be immediately followed by further comminuting means disposed laterally of the rotating flails at the discharge opening of the container. This further comminuting means is formed by a frame containing upper and lower traverses; generally arcuately shaped struts extend between the upper and lower traverses in a spaced parallel relationship to each other and have teeth protruding upwardly in opposition to the rotating flails. The comminuted material is thereby subjected to further comminution and forced out through the spaces existing between the struts. The further comminuting means is pivotally mounted by means of the upper traverse.

In both of the aforementioned comminuting machines the impact plate as well as the further comminuting means are pivotably supported so as to pivot away from the rotating flails in the event that the infed material contains pieces of material which do not disintegrate under the action of the rotating flails in cooperation with the impact plate. The rotary impact mechanism and the impact plate are thus prevented from damage by pieces of non-disintegratable material. Hydraulic displacement means are provided in the Doppstadt AK 330 shredder on the outer side of the impact plate and linked to the further comminuting means for displacing the same between an operative position, in which the container discharge opening is covered thereby, and an inoperative position, in which the further comminuting means is pivoted away from the container discharge opening.

Furthermore, both of the aforementioned comminuting machines are mobile machines mounted at a support frame on wheels. Such wheel support can be provided by supporting the comminuting machine on a truck such as known from European Patent No. 0,212,194, the grant of which to the applicant of the instant application was published on Oct. 11, 1987; in such construction the engine of the truck also serves to drive the comminuting machine. The wheel-supported support frame may also carry the drive means for operating the comminuting machine; as described in the aforementioned U.S. patent, such comminuting machine may be displaced at the given working location by means of the shovel loader used for charging the comminuting machine. The support frame may also be supported at a tandem axle. Pressure fluid operated drive means acting upon the front wheels of the tandem axle may be provided for displacing the comminuting machine at the working location (Doppstadt shredder AK 330). Remote control means may be used for controlling the operation of the comminuting machine including the pressure fluid operated drive means. While the machine can be operated in this manner independent of a truck, travel to a different working location requires connection to a towing vehicle like a tractor or truck.

Still further, both of the aforementioned mobile comminuting machines are equipped with an overload coupling and/or overload control means which are responsive to deceleration of the rotary impact mechanism in the presence of excessive infed material to be comminuted. Such overload coupling mainly serves to dampen rapid transient variations in the rotational speed of the rotary impact mechanism due to a momentary overload so that the same do not or only little affect the prime mover. The overload control means react to the overload by decelerating and eventually stopping the infeed drive means as a function of the rotational speed of the rotary impact mechanism.

A stationary comminuting machine such as known, for example, from German Published Patent Application No. 2,902,257, published on Jul. 31, 1980, is intended for comminuting particularly confidential files but also waste materials of any kind including waste wood. Infeed means like infeed rolls feed the material to be comminuted to an inlet gap and into the interior of the drum-like housing. Parts of the infed material protrude through the inlet gap and are severed or chopped off by a rotary impact mechanism. The drum-like housing of the comminuting machine accommodates a basically segment-shaped impact body defining a throughpass gap in cooperation with the rotary impact mechanism. The throughpass gap narrows from an inlet for infeeding the material to be comminuted to an outlet and extends around the upper half of the rotary impact mechanism. The impact body is mounted at the drum-like housing by means of bolts permitting adjustment of the impact body in radial direction relative to the rotary impact mechanism. At its rear end, as viewed in the rotational direction of the rotary impact mechanism, the impact body bears upon a stop. The impact body is provided on its inner side with, for example, a saw-tooth profile which extends parallel to the axis of the rotary impact mechanism. The impact body is followed, in the rotational direction of the rotary impact mechanism, by grate means which extends around the lower half of the rotary impact mechanism and defines a throughpass gap which narrows in the rotational direction.

A stationary comminuting machine or pulverizer such as known, for example, from U.S. Pat. No. 1,125,137 is constructed as a hammer mill into which the material to be comminuted is dropped from the top. The incoming material is hit by a rotary shaft with spiders extending radially therefrom and provided with swinging hammers at their free ends. The hammers cooperate with different breaking plates extending in sequence around part of the circumference defined by the rotating hammers. A first breaking plate presents a smooth surface to the rotating hammers; a second breaking plate is provided with a sequence of teeth formed by faces which rise from the plate in the direction of rotation of the rotating hammers; a third breaking plate extends along the lower half of the circumference described by the rotating hammers and contains a number of bars arranged at an angle relative to the associated faces of the rotating hammers. The spaces between the bars serve as discharge openings for the comminuted material. A section of the support structure for the bars of the third breaking plate can be pivoted away from the circumference described by the rotating hammers by manually operated pivot means in order to permit removal of material which can not be sufficiently reduced.

A further stationary comminuting machine or reduction mill such as known, for example, from U.S. Pat. No. 4,226,375, granted Oct. 7, 1980, is also constructed in the manner of a hammer mill into which the material to be comminuted is dropped from the top. The incoming material is hit by a rotary body from which the hammers protrude in essentially radial direction. An anvil wall extends along a lower quadrant of the rotary body and defines a channel which narrows in the rotary direction of the rotary body. The anvil wall is immediately followed by a grate section extending laterally of the rotary body over an angle of 140° to 170°. The grate section cooperates with the rotating hammers in a manner such that the infed material is further comminuted and forced through screen openings of the grate section. The grate section is formed by a circumferentially sequential assembly of cutter bars and screen bars which are mounted in a common housing. The housing can be pivoted away from the rotary body in order to permit access for maintenance and repair operations on the grate section and the hammers.

In a further known stationary comminuting machine such as a hammer mill known from USSR Author Certificate No. 1,230,678, published May 15, 1986, the material to be comminuted is dropped from the top onto rotating hammers of a rotor which cooperate first with an impact plate which is arranged above the rotating hammers and extends generally in the direction of rotation of the rotating hammers. The impact plate is provided with transversely and lengthwisely extending ribs protruding toward the rotating hammers. A second impact plate follows the first impact plate at an obtuse angle relative thereto; this second impact plate is provided with angular impact elements defining tips which are directed toward the rotating hammers. This second impact plate is immediately followed by a third, planar impact plate downwardly inclined toward the rotor. Finally, a grate immediately follows the third impact plate and semicylindrically surrounds the lower half of the rotor. The comminuted material is forced and discharged through the grate under the action of the rotating hammers.

Contrary to the first mentioned mobile waste comminuting machines, the last mentioned stationary comminuting machines are not provided with any means permitting the impact plates and other structures which cooperate with the rotating hammers, to yield in the presence of non-disintegratable material.

Regarding the aforementioned mobile waste comminuting machines, the comminuting actions realized therein have been found to be unsatisfactory not only with respect to the further comminuting effect which can be achieved after the material has been forced past the impact plate, but also with respect to the insufficient variability in adaptation to the material to be comminuted and the overall extent of the achievable comminution. Thus, for example, the degree of comminution required for a subsequent composting process is higher than the degree of comminution required for the disintegration of wood waste like boarding.

SUMMARY OF THE INVENTION

Therefore, with the foregoing in mind, it is a primary object of the present invention to provide a new and improved construction of a comminuting machine which is not afflicted with the drawbacks and limitations of the prior art constructions heretofore discussed.

Another and more specific object of the invention is directed to the provision of a new and improved construction of a comminuting machine in which the further comminuting means permits ready adaptation to different comminution requirements.

A further significant object of the present invention resides in providing a new and improved construction of a comminuting machine in which the further comminuting means are protected against damage by pieces of non-disintegratable material.

Now in order to implement these and still further objects of the invention, which will become more readily apparent as the description proceeds, the comminuting machine of the present development is manifested by the features that, among other things, the impact plate is followed in the rotary direction of the rotary impact mechanism by at least one comminuting grate which is exchangeably mounted at the comminuting machine and contains a multitude of throughpass openings distributed across the at least one comminuting grate.

The comminuting grate is exchangeably arranged. As a consequence, comminuting grates having throughpass openings of different size can be installed at the comminuting machines in accordance with the particularly desired comminution degree.

Advantageously, the throughpass openings are of rectangular shape and extend through the comminuting grate at an angle deviating from the right angle. The reason therefore is that there is formed in this manner a ridge-shaped edge of the throughpass opening on the rear end as viewed in the rotational direction of the rotary impact mechanism. Such ridge-shaped edge faces or opposes the material which is advanced along the comminuting grate and enters the throughpass openings thereof under the action of the rotating flails, and thus exerts a quite considerable and extraordinary breaking or crushing and, maybe, shearing action on the material subjected to the further comminuting operation. This action may be additionally assisted by providing the ridge-shaped edge with a profile which protrudes into the throughpass opening.

Preferably, the comminuting grate comprises an arcuate plate arranged at a close radial spacing from the cylindrical area of action defined by the rotary impact mechanism and extending over a predetermined arc region thereof. The aforementioned impact plate, then, may also have a generally arcuate shape. The front end of the comminuting grate, as viewed in the rotary direction of the rotary impact mechanism, closely adjoins the associated rear end of the impact plate.

In a further advantageous construction of the inventive comminuting machine the further comminuting means may comprise a first comminuting grate arranged such as to laterally cover the rotary impact mechanism and a second comminuting grate arranged below the rotary impact mechanism and closely following the first comminuting grate.

BRIEF DESCRIPTION OF THE DRAWINGS

The invention will be better understood and objects other than those set forth above, will become apparent when consideration is given to the following detailed description thereof. Such description makes reference to the annexed drawings wherein the same or analogous components are designated by the same reference characters and wherein.

BRIEF DESCRIPTION OF THE PREFERRED EMBODIMENTS

Figures 1, 4:
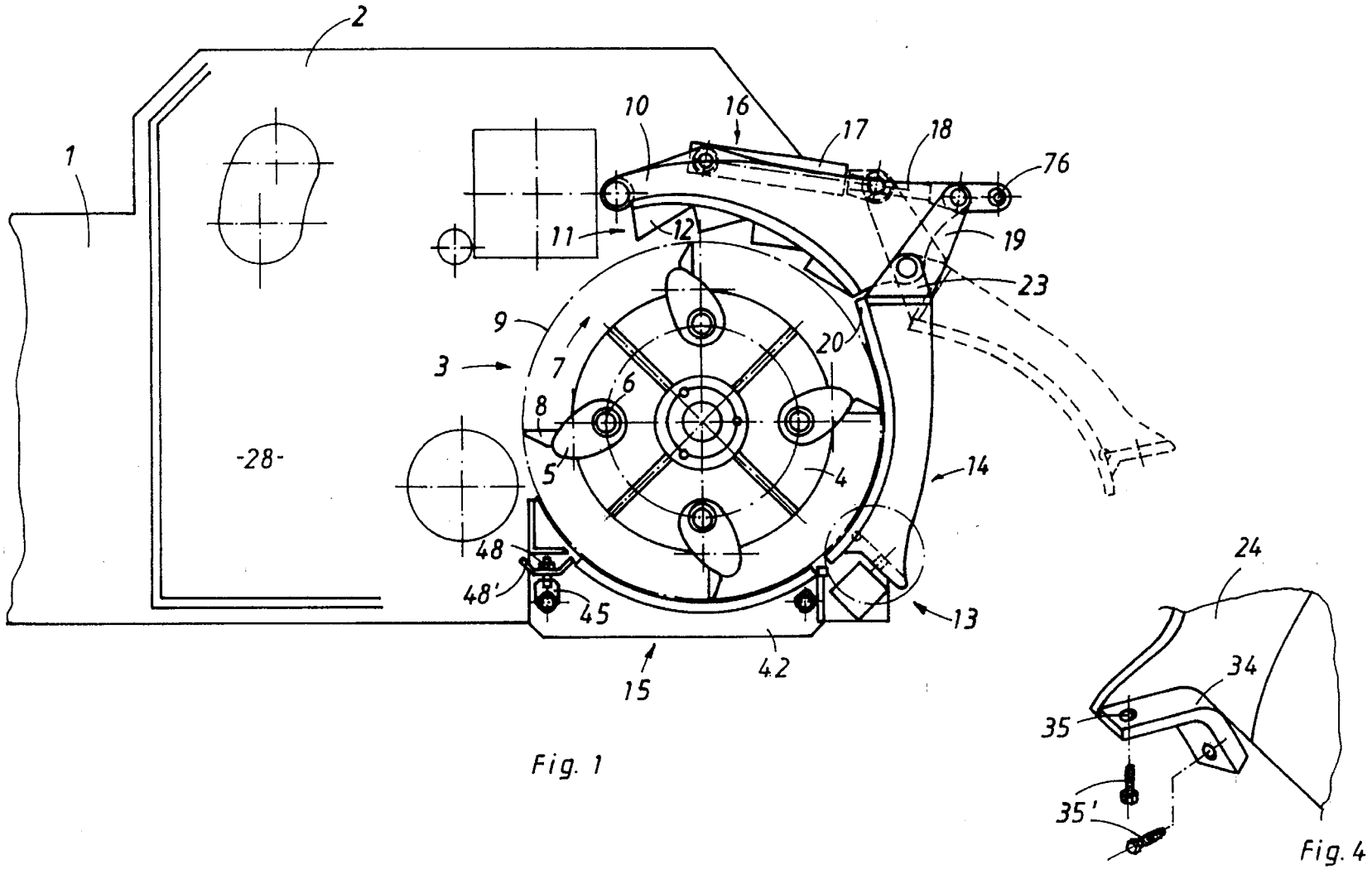
FIG. 1 is a schematic, partially sectional side view of an exemplary embodiment of the inventive comminuting machine.
FIG. 4 is a perspective view of adjusting means associated with one end of a first comminuting grate in the comminuting machine as shown in FIG. 1.

Describing now the drawings, it is to be understood that only enough of the construction of the comminuting machine has been shown as needed for those skilled in the art to readily understand the underlying principles and concepts of the present development, while simplifying the showing of the drawing. Generally, the inventive comminuting machine includes a stationary or mobile housing which houses a rotary impact mechanism and receives the material to be comminuted. The drawings specifically show examples of a waste wood comminuting machine for comminuting waste wood of the type as occurring in forestry, municipality and building or constructing operations. While the illustrated exemplary embodiments are concerned with a mobile machine of this type which is supported at a wheel-supported support frame which also carries the drive means for operating the machine, it will be understood that the inventive construction can also be realized in connection with a truck supported mobile comminuting machine. Also, the illustrated exemplary embodiments may be provided with independent drive means as disclosed in the initially cross-referenced, copending U.S. patent application. Naturally, the inventive construction is not limited to the illustrated examples of waste wood comminuting machines but can also be realized in connection with comminuting machines for processing other kinds of material and based on the same basic constructional principles.

Turning attention now to FIG. 1 of the drawings, there has been shown in a schematic, partially sectional side view a comminuting machine 1 and a housing 2 thereof. This housing 2 may constitute, for example, the rear part of a trough-shaped container having a not particularly illustrated central portion which receives the material to be comminuted. Conveying means such as a scraper conveyor and an intake roll convey the infed material to this rear portion which houses the actual comminuting mechanism to be described hereinbelow. In a front portion (not shown) of the comminuting machine, there may be located drive means for operating the comminuting machine. Such drive means may comprise, for example, a diesel engine representing the prime mover and a hydraulic drive system including an axial piston pump which is in driving connection with the prime mover and which supplies hydraulic oil to various hydraulically operated components of the comminuting machine.

The actual comminuting mechanism is accommodated by the housing or rear part 2 of the container. This mechanism is constituted by a rotary impact mechanism 3 which is, in the illustrated embodiment, of known construction containing a drum 4 equipped with flails 5 each of which is pivotably supported about a pivot axis 6. During revolution of the drum 4 in the rotational direction as indicated by the arrow 7, the flails 5 are subject to a centrifugal force and pivot outwardly in known manner. As a result, cutting members 8 of the flails 5 define a cylindrical area 9 of action. The material to be comminuted is infed into the area 9 of action of the rotary impact mechanism 3 by means of, for example, a conveying device like the initially mentioned scraper conveyor.

Figure 3:
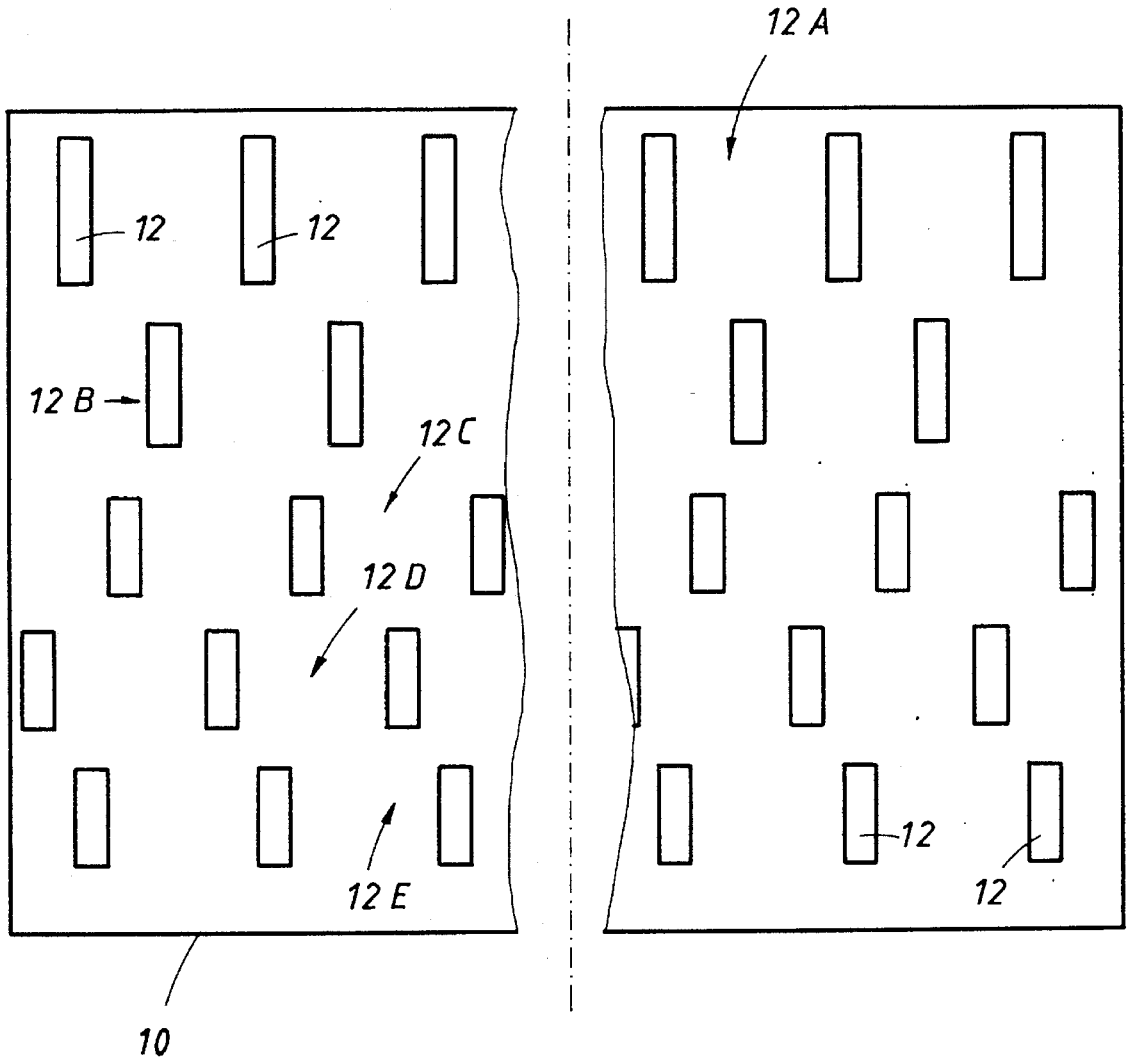
FIG. 3 is a partial top plan view of the inner side of an impact plate in the comminuting machine as shown in FIG. 1.

An impact plate 10 is arranged in the container rear part 2 for cooperation with the area 9 of action of the rotary impact mechanism 3. The impact plate 10 extends in an arcuate manner along a top portion of the area 9 of action defined by the rotary impact mechanism 3 to define a throughpass gap 11 which narrows in the rotational direction of the rotary impact mechanism 3 or the rotating flails 5. Teeth 12 protrude from an inner side of the impact plate 10 in a direction opposing the rotational direction 7 of the rotary impact mechanism 3, namely in a manner such that the protruding height of the teeth 12 above the inner side of the impact plate 10 decreases in the rotational direction 7. As illustrated in FIG. 3, the teeth 12 are arranged across the inner side of the impact plate 10 in a plural number of rows such as 12A,12B,12C,12D and 12E which extend substantially parallel to each other and substantially transverse with respect to the rotational direction 7 of the rotary impact mechanism 3. The parallel rows of teeth are transversely offset from each other in a manner such that the formation of longitudinal teeth rows extending parallel to the rotational direction 7 is avoided. This has a beneficial effect on the comminution efficiency of the machine.

At its front end, as viewed in the rotational direction 7, the impact plate 10 is pivotably supported at the side walls 27 and 28 of the container rear part 2. With its rear end, as viewed in the rotational direction 7, the impact plate 10 rests upon stops (not shown) located at the inner face of the side walls 27,28, see FIG. 2. In this manner it will be achieved that non-disintegratable pieces of material like metallic articles or stones can not cause damage at the impact plate 10 because the impact plate 10 is pivotably raised in the presence of such non-disintegratable pieces and thus permits the same to pass through the throughpass gap 11.

As known in the art, the impact plate 10 may be preceded by an impact ledge which cooperates with the rotating flails 5 of the rotary impact mechanism 3 to define an entrance gap leading to the throughpass gap 11. There is thus provided a first comminuting action on the infed material which is taken up and thrown onto the impact ledge and forced through the entrance gap by the rotating flails 5.

The impact plate 10 is followed in the rotational direction 7 by further comminuting means 13. In the illustrated exemplary embodiment, the further comminuting means 13 encompasses two members, namely a first comminuting grate 14 which covers a discharge opening of the container rear part 2 by being arranged on one side laterally of the rotary impact mechanism 3, and a second comminuting grate 15 disposed below the rotary impact mechanism 3. The further comminuting means 13 are located at a close radial spacing from the area 9 of action of the rotary impact mechanism 3 or the rotating flails 5. The material which issues from the throughpass gap 11 as defined by the impact plate 10, is driven on by the rotary impact mechanism 3 in the rotational direction 7. It is subjected to further comminution due to the cooperation of the rotary impact mechanism 3 and the further comminuting means 13 and thereby forced through the same. Any material which is not passed through the further comminuting means 13, is driven further on by the cutting members 8 of the rotating flails 5 which rotate at the relatively high rotational speed of, for instance, 1000 revolutions per minute, in the rotational direction 7 and thus passed through the comminuting machine a further time.

In FIG. 1, the first comminuting grate 14 is shown in its operative, closing position in which the discharge opening of the container rear part 2 is closed or covered by the first comminuting grate 14. Broken lines therein indicate that the first comminuting grate 14 can be pivoted from this operative position into an inoperative, open position in which it is pivoted away from the area 9 of action of the rotary impact mechanism 3 and the discharge opening of the container rear part 2 is open. Pressure fluid operated displacing means 16 serve this purpose and have the form of double acting pressure fluid operated piston-cylinder units 17,18 of which at least one is disposed on the outer side of the impact plate 10. The double acting pressure fluid operated piston-cylinder units 17,18 are linked to the outside of the impact plate 10. Piston rods 18 of the double acting pressure fluid operated piston-cylinder units 17,18 have a free end which is linked to upwardly projecting brackets 19 which are fixedly arranged at the first comminuting grate 14 on its front end 20 as viewed in the rotational direction 7.

Figure 2:
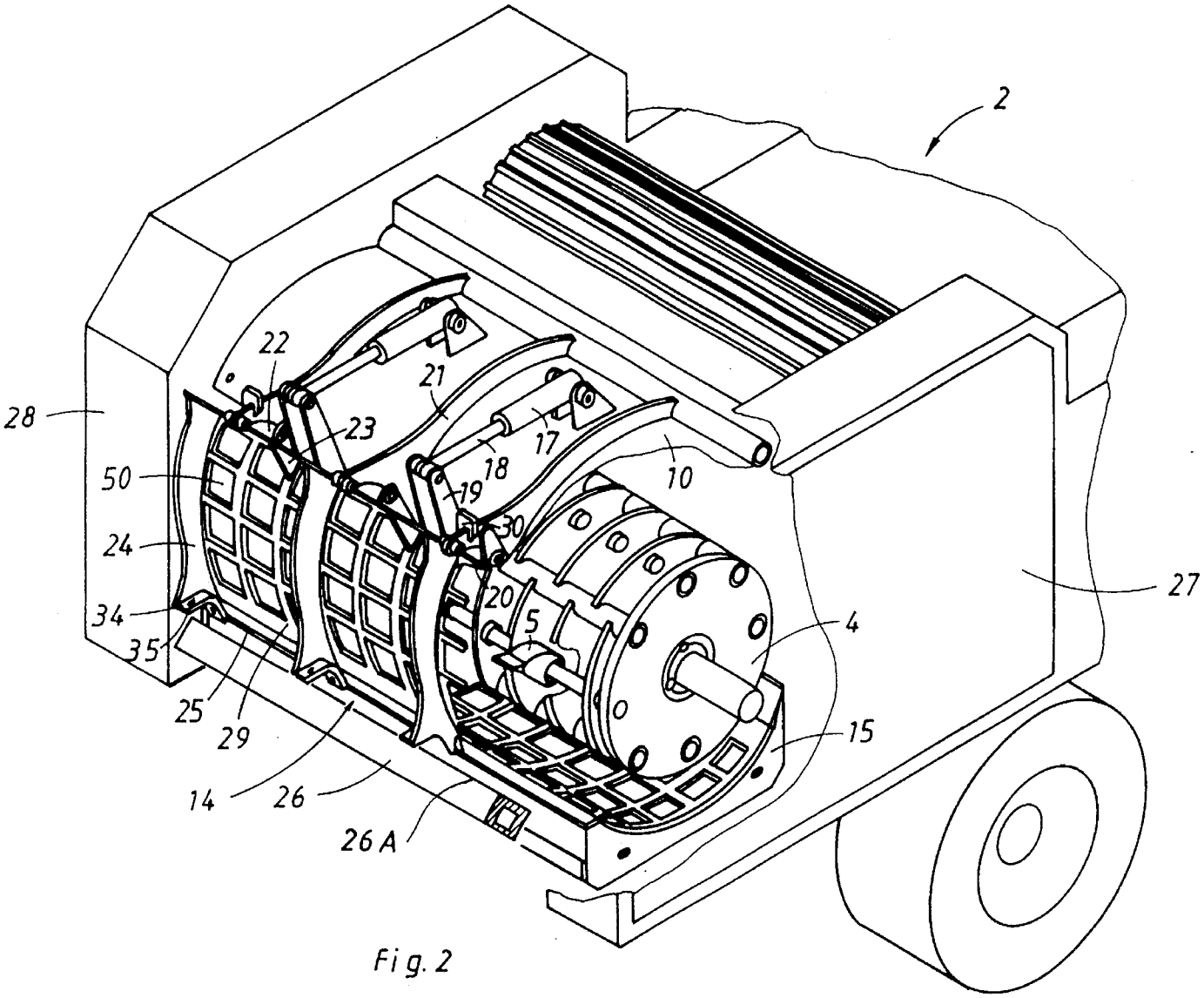
FIG. 2 is a perspective, partially sectional view of the comminuting machine as shown in FIG. 1.

The arrangement of the first comminuting grate 14 will be recognized in more detail in FIG. 2. The first comminuting grate 14 immediately follows the impact plate 10. This is accomplished in that the impact plate 10 is provided with a plural number of carriers 21 which are disposed on the outer side of the impact plate 10 and extend in the rotational direction 7 beyond the impact plate 10 to protrude toward the front end 20 of the first comminuting grate 14. The carriers 21 comprise respective mounting members 22 which are linked to respective link members 23 fixedly connected to the front end 20 and rising therefrom. The free ends 76 of the carriers 21 as shown in FIG. 1 are linked to the cover plate 71, see FIG. 14. On its outer side, the first comminuting grate 14 has a plural number of supports 24 which extend parallel to each other from the front end 20 to a rear end 25 of the first comminuting grate 14, as viewed in the rotational direction 7. The supports 24 are supported on the rear end 25 of the first comminuting grate 14 by means of a rest 26 provided at the container rear part 2. In the illustrated exemplary embodiment, the rest 26 extends between the side walls 27 and 28 of the container rear part 2 and is constructed as a rectangular tube. The rest 26 is arranged such that a corner portion 26A of the rectangular tube assumes a top position.

The first comminuting grate 14 is made of an arcuate plate 29 which has a curvature adapted to the area 9 of action of the rotary impact mechanism 3. Adjusting means 30 to 35,35' are provided for more accurate adaptation and adjustment thereto. In the illustrated exemplary embodiment this adjusting means consists of two adjusting means 30 to 33 and 34,35,35' one of which is provided on the front end 20 and an other one of which is provided on the rear end 25 of the first comminuting grate 14, as viewed in the rotational direction 7.

Figure 5:
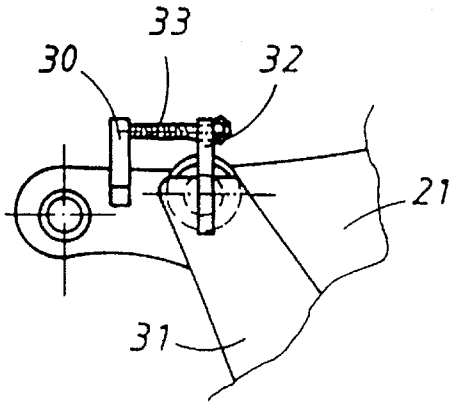
FIG. 5 is a side view of adjusting means associated with an other end of the first comminuting grate in the comminuting machine as shown in FIG. 1.
Figure 7:
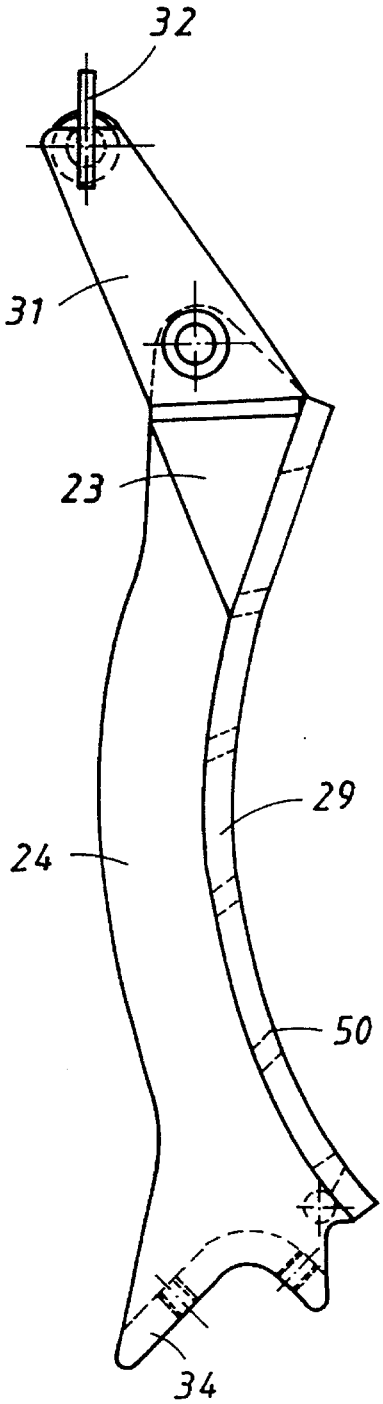
FIG. 7 is a partially sectional side view of the comminuting grate as shown in FIG. 6.

In detail, the adjusting means 30 to 33 for adjusting the arcuate plate 29 on the front end 20 is formed in connection with the carriers 21 at the impact plate 10. Stops 30 are mounted at the protruding ends of the carriers 21, see FIG. 2; an arm 31 attached to the associated link member 23 has a holder 32, as shown in FIGS. 5 and 7. The holder 32 is traversed by an adjusting member 33 which is constructed as an adjusting screw engaging the stop 30. Operation of the adjusting members or screws 33 will move the front end 20 of the first comminuting means 14 or the arcuate plate 29 toward or away from the area 9 of action of the rotary impact mechanism 3.

The adjusting means 34,35,35' for adjusting the rear end 25 of the first comminuting grate 14 or the arcuate plate 29, as viewed in the rotational direction 7, is provided at the lower ends of the supports 24, see FIGS. 2 and 4. For this purpose, the lower ends of at least two of the supports 24 have mounted thereto respective, substantially rectangular angle members 34 which are are arranged substantially parallel to the rest 26. Adjusting members 35' in the form of adjusting screws threadably engage with and pass through associated threaded bores 35 in the legs of the angle members 34 to engage the rest 26. Operation of the adjusting members or screws 35' will move the rear end 25 of the first comminuting means 14 or the arcuate plate 29 toward or away from the area 9 of action of the rotary impact mechanism 3.

The aforedescribed adjusting means can be present at each one or only at selected ones of the links 23 and supports 24.

Holding means 26,34 are provided for holding the first comminuting grate 14 in the operative, closing position. The angle members 34 of the adjusting means 34,35,35', which are provided at the lower ends of the lateral supports 24 on the outer side of the first comminuting grate 14, are substantially rectangular angle members which extend parallel to the upwardly directed corner portion 26A of the rest or rectangular tube 26. However, the ends of the angle members 34 are disposed at a lower level than the corner portion 26A. Consequently, the angle members 34 snap over the corner portion 26A when the first comminuting grate 14 is moved from the inoperative, open position to the operative, closing position. The first comminuting grate 14 is thus prevented from accidental re-opening because the ascending part of the corner portion 26A presents a resistance to such movement.

Figure 8:
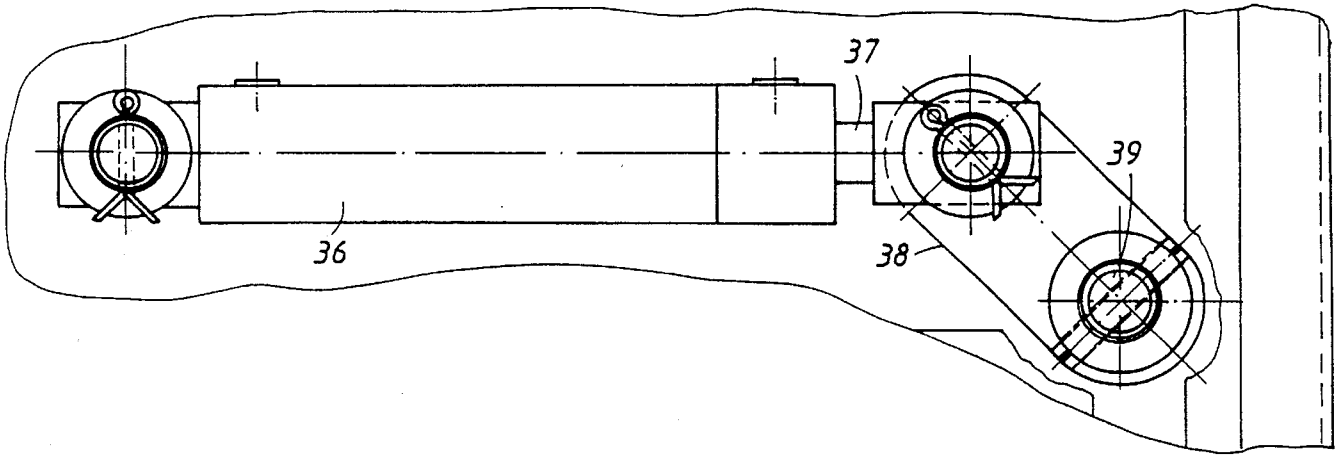
FIG. 8 is a side view of hold-and-release means for the first comminuting grate as shown in FIG. 6.
Figure 9:
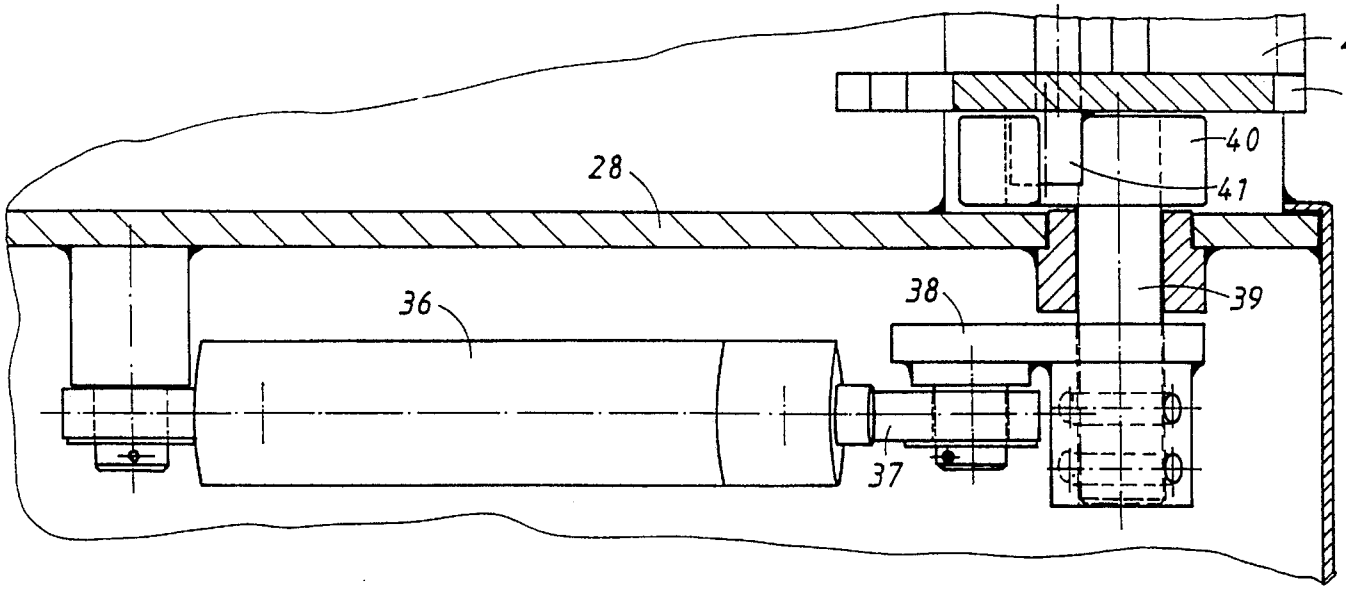
FIG. 9 is a top plan view of the hold-and-release means as shown in FIG. 8.
Figure 12:
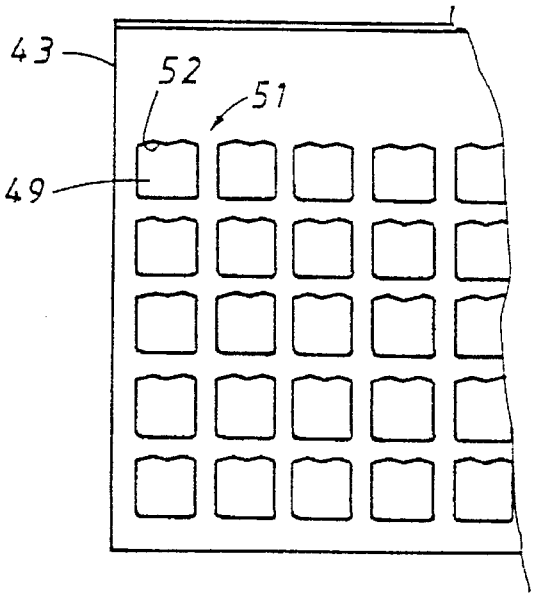
FIG. 12 is a top plan view of the second comminuting grate as shown in FIG. 10.
Figure 11:
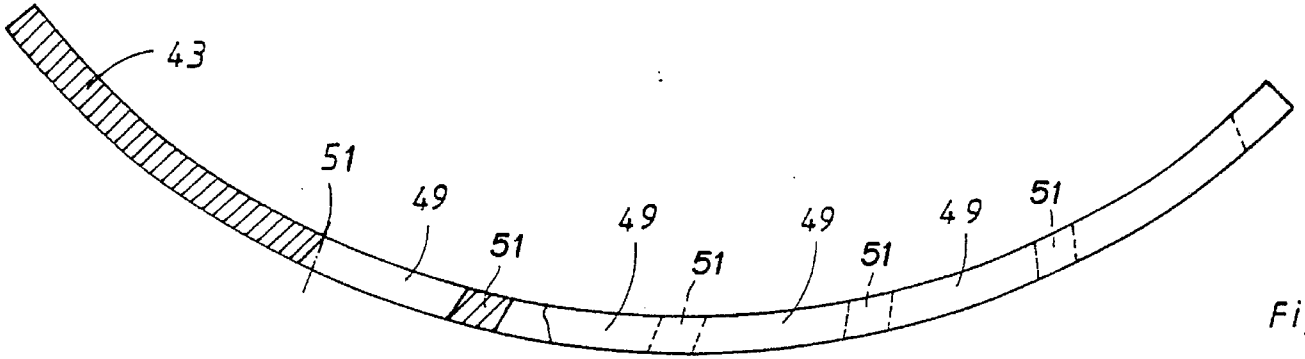
FIG. 11 is a sectional view of a second comminuting grate in the comminuting machine as shown in FIG. 1 and in the modified second comminuting grate as shown in FIG. 10.

Additionally, hold-and-release means 36 to 41 are provided which engage the first comminuting grate 14 in its operative, closing position. The hold-and-release means 36 to 41 are illustrated in FIGS. 8 and 9 and are mounted at the side walls 27 and 28 of the container rear part 2. As specifically illustrated in connection with the side wall 28, the hold-and-release means 36 to 41 include pressure fluid operated moving means 36,37 linked to a crank arm 38. The crank arm 38 is connected with a crank shaft 39 which extends through the side wall 28 of the container rear part 2 and carries a hook-shaped member 40 which is located on the inner side of the side wall 28. The associated support 24 on this side of the first comminuting grate 14 defines a side facing the inner side of the side wall 28. This side of the support 24 carries a holding pin 41 projecting toward the side wall 28. The pressure fluid operated moving means 36,37 include a double acting hydraulic piston-cylinder unit. The piston 37 thereof has a free end which is linked to the crank arm 38. In the retracted position of the piston rod 37, as shown in FIG. 9, the hook-shaped member 40 is in holding engagement with the holding pin 41 whereby the first comminuting grate 14 or the arcuate plate 29 is held in its operative, closing position. Upon operating the double acting hydraulic cylinder 36 to extend the piston rod 37, the hook-shaped member 40 pushes the holding pin 41 over the corner portion 26A of the rest or rectangular tube 26 and thus assists in releasing the first comminuting grate 14 for pivoting into the inoperative, open position shown by broken lines in FIG. 1.

Figure 13:
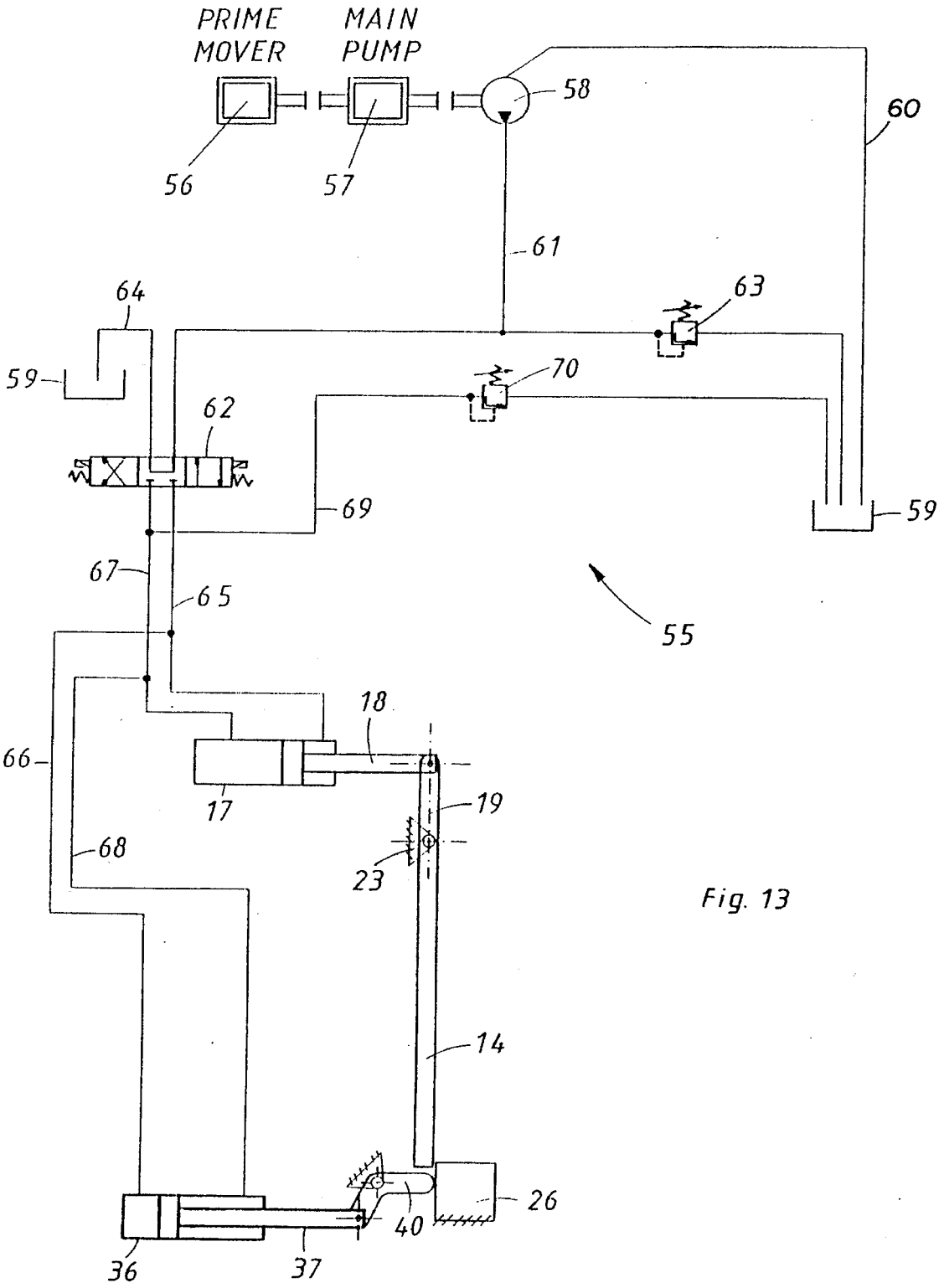
FIG. 13 is a schematic circuit diagram of pressure fluid operated control means controlling the position of the first comminuting grate in the comminuting machine as shown in FIG. 1.

The aforementioned displacing means 16 provided at the outer side of the impact plate 10 and the last mentioned hold-and-release means 36 to 41 are operatively coupled with each other. This particular coupling serves the purpose of assisting the pivoting movement of the first comminuting grate 14 from the operative position in which it closes the container discharge opening, into the inoperative, open position. The coupling is effected by pressure fluid operated control means 55 which is schematically shown in FIG. 13 and will be explained hereinafter.

The comminuting machine 1 is equipped with a power unit which includes in conventional manner a prime mover 56 like, for example, a diesel engine and a hydraulic main pump 57 such as an axial piston pump. The hydraulic main pump 57 is in driven connection with the prime mover 56 and communicates with an oil pump like, for example, a gear pump 58. The gear pump 58 has an input connected to an oil reservoir through a line or conduit 60, and an output which is connected through a line or conduit 61 to a control valve 62, namely a 4/3-way valve, and through a pressure limiting valve 63 to the oil reservoir 59.

The 4/3-way valve 62 is connected to a first portion of the double acting hydraulic cylinder 17 of the displacing means 16 through a first line or conduit 65. A branch line 66 leads therefrom to a second portion of the double acting hydraulic cylinder 36 of the moving means 36,37. Similarly, a second line or conduit 67 leads from the 4/3-way valve 62 to a second portion of the double acting hydraulic cylinder 17 from which a branch line 68 extends to a first portion of the double acting hydraulic cylinder 36. A further branch line 69 extends from the second line or conduit 67 to the oil reservoir 59 through a pressure limiting valve 70.

The pressure fluid operated control means 55 function as follows:

FIG. 13 shows the hydraulic control means 55 in a normal state in which the first comminuting grate 14 is in the operative, closing position. In this normal state, as schematically illustrated, the piston rod 18 of the displacing means 16 is extended and the piston rod 37 of the moving means 36,37 is retracted. The 4/3-way valve 62 is in a first, short-circuited position in which the line or conduit 61 is connected to the oil reservoir 59 through a line or conduit 64.

The 4/3-way valve 62 can be manually switched into a second position, in which the line or conduit 61 is connected to the first line or conduit 65 and the line or conduit 64 to the second line or conduit 67. Consequently the first portion of the double acting hydraulic cylinder 17 and the second portion of the double acting hydraulic cylinder 36 are pressurized and the piston rod 18 is retracted while the piston rod 37 is extended. As a result, the first comminuting grate 14 is pivoted into the inoperative, open position; this pivoting movement is assisted by the hook-shaped member 40 which is pivoted in a direction such that the angle member 34 is pushed over the corner portion 26A of the rest 26.

When the first comminuting grate 14 is intended to be returned into the operative, closing position, the 4/3-way valve 62 is manually switched into a third position. In this third position, the line or conduit 61 is connected to the second line or conduit 67 and the line or conduit 64 to the first line or conduit 65. Consequently, the second portion of the double acting hydraulic cylinder 17 and the first portion of the hydraulic cylinder 36 are pressurized and the piston rod 18 is extended while the piston rod 37 is retracted. As a result, the first comminuting grate 14 is pivoted into the operative, closing position and the hook-shaped member 40 is pivoted back in a direction such that the angle member 34 is enabled to snap back over the corner portion 26A of the rest 26.

In the event that a piece of non-disintegrable material passes through the throughpass gap 11 defined between the impact plate 10 and the rotary impact mechanism 3 under the action of the rotary impact mechanism 3, such piece of non-disintegratable material will act upon the first comminuting grate 14 to pivot the same into the inoperative, open position. Consequently, the piston rod 18 will be displaced toward the second portion of the double acting hydraulic cylinder 17 and the oil will be displaced therefrom through the pressure limiting valve 70 to the oil reservoir 59. The exerted force will be sufficient to push the angle members 34 over the corner portion 26A of the rest 26. Since the branch line 68 is connected to the pressurized first portion of the hydraulic cylinder 36, this movement will not be assisted by the hook-shaped member 40. Due to the fact that the 4/3-way valve 62 remains in the illustrated first position, the first comminuting grate 14 will remain in the inoperative open position also after the piece of non-disintegrable material has passed through the discharge opening of the container rear part 2. In order to return the first comminuting grate 14 into its operative, closing position, the 4/3-way valve 62 is manually switched into the aforementioned third position.

Figure 14:
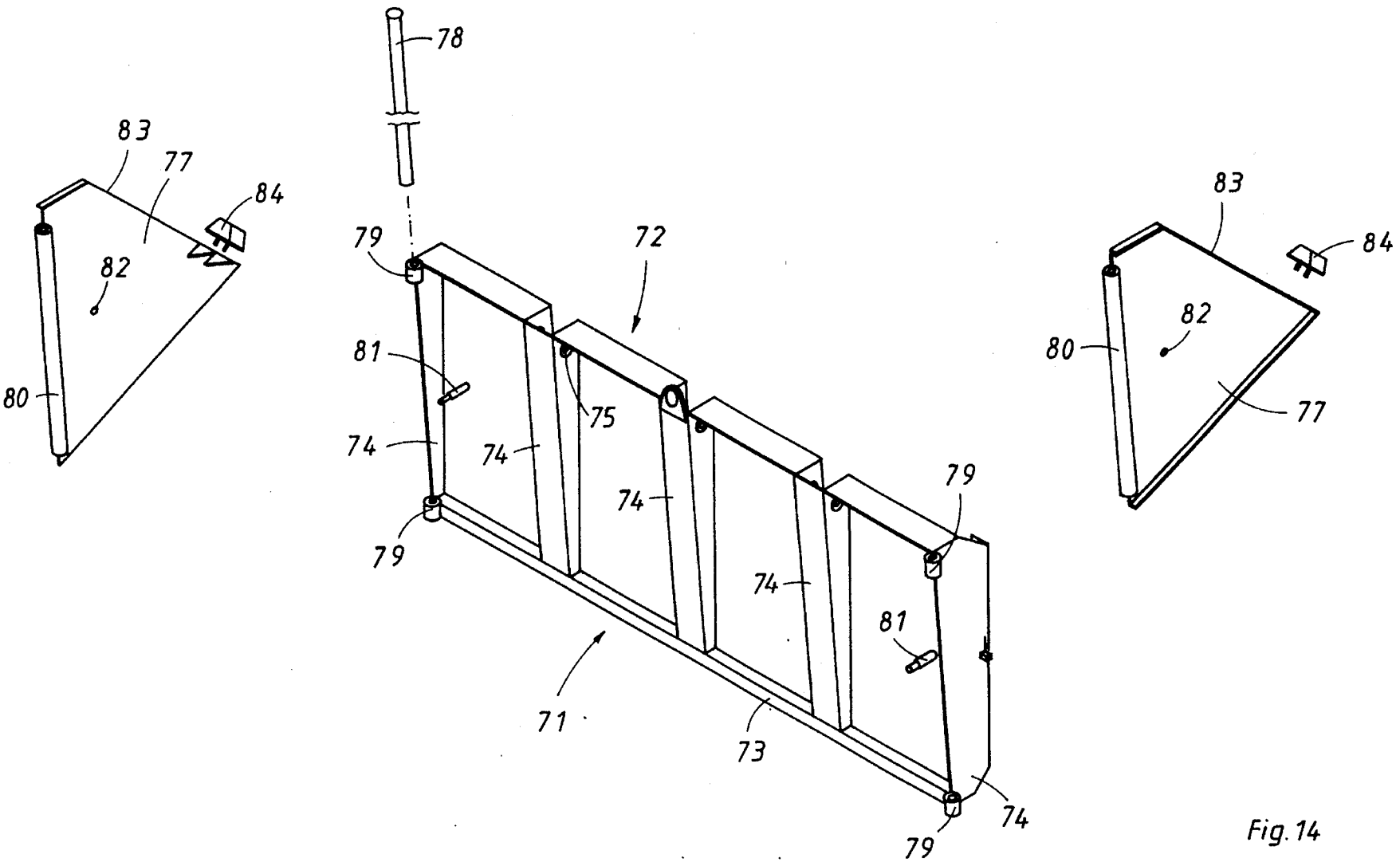
FIG. 14 is a perspective view of a cover plate covering the first comminuting grate in the inoperative state of the comminuting machine as shown in FIG. 1 and downwardly directing the comminuted material issuing from the first comminuting grate in the operative state of the comminuting machine as shown in FIG. 1.

Furthermore, the first comminuting grate 14 and thus the discharge side of the comminuting machine 1 is provided with a cover plate 71 and means for holding the cover plate 71 in a closed position and in an open position, see FIG. 14. Specifically, the cover plate 71 constitutes a plastic or sheet metal plate defining a top side and a bottom side wich are provided with reinforcements 72 and 73 extending therealong. The reinforcement 72 on the top side is interrupted by further reinforcements 74 extending at mutual spacings between the top and bottom reinforcements 72 and 73. The top ends of the reinforcements 74 contain linking holes 75 by means of which the cover plate 71 is linked to the link members 76 as shown in FIG. 1 at the free ends of the carriers 21 which extend along the outer side of the impact plate 10.

In the inoperative state of the comminuting machine 1, the cover plate 71 closes the discharge side of the first comminuting grate 14 by being dependent from the link members 76. Holding means of suitable conventional construction, particularly spring loaded holding means, are provided at the lower portion of the container rear part 2 for holding the dependent cover plate 71, if desired. Trapezoidally shaped support members 77 are pivotably mounted on the lateral sides of the cover plate 71 by means of respective pivot shafts 78 which extend through respective eyes 79 fixed to the four corners of the cover plate 71 and a pivot bearing 80 mounted at the associated sides of the respective support members 77. The outer side of the cover plate has affixed thereto two holding pins 81 which are received in associated holes 82 of the support members 77. Linch pins or equivalent means are used to secure the support members 77 in the inwardly pivoted position in the inoperative state of the comminuting machine 1.

The cover plate 71 fulfills a different function in the operative state of the comminuting machine 1. In such state, the cover plate 71 is upwardly pivoted about the link connection at the link member 76 of the carriers 21 and the support members 77 are released from the holding pins 81. The support members are pivoted about the respective bearing shafts 78 into a position in which their edges 83 abut the outer side of the container rear part 2. Rubber or plastic buffers 84 are provided at the edges 83 for preventing damage. Consequently, the cover plate 71 is supported at the container rear part in an upwardly pivoted position such that the cover plate extends in the downward direction of the rear portion of the impact plate 10. It is thereby achieved that any upwardly directed comminuted material which issues from the first comminuting grate 14, is downwardly deflected toward the stack or pit of accumulating comminuted material.

Figure 10:
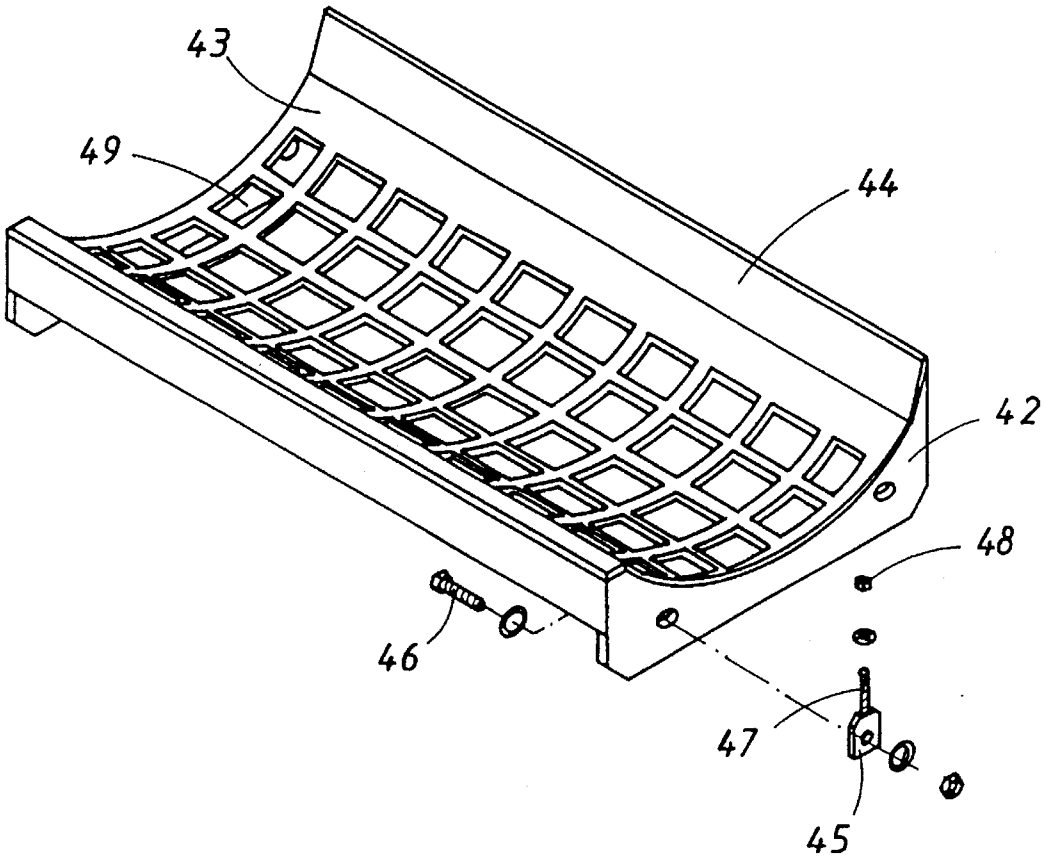
FIG. 10 is a perspective view of a modified second comminuting grate in the comminuting machine as shown in FIG. 1.

The second comminuting grate 15 is shown in FIGS. 1 and 2 as well as 11 and 12; a modified construction is illustrated in FIG. 10. The second comminuting grate 15 is formed by a frame 42 supporting an arcuate plate 43 and releasably mounted at the opposite side walls 27 and 28 of the container rear part 2. According to FIGS. 1 and 2, the second comminuting grate 15 practically immediately adjoins the first comminuting grate 14. The frame 42 is composed of lengthwise and transverse frame members which are firmly connected such as by welding to each other as well as the arcuate plate 43.

The first and second comminuting grates 14 and 15 are preferably structured and/or arranged such that the throughpass openings 49 in the first comminuting grate 14 are not in alignment with the throughpass openings 49 in the second comminuting grate 15, as viewed in the rotational direction 7 of the rotary impact mechanism 3. In fact, the throughpass openings 49 in the second comminuting grate 15 are transversely offset from those present in the first comminuting grate 14.

The frame 42 of the second comminuting grate 15 is adjustably retained at the side walls 27 and 28 of the container rear part 2 by adjusting means 45 to 48 which permits adjusting the arcuate plate 43 toward and away from the rotary impact mechanism 3. The adjusting means 45 to 48, as shown in FIG. 10, includes an adjusting member 45 which is fixedly, but releasably connected to the frame 42, in the illustrated exemplary embodiment by means of screws or bolts 46 which are used for mounting the frame 42 at the side walls 27 and 28. These screws or bolts 46 extend through respective elongate holes in the side walls 27 and 28. The adjusting member 45 contains a threaded portion 47 extending through a stop 48' which is located at the outer side of the associated side wall 27 or 28 of the container rear part 2, see FIG. 1. The threaded portion 47 carries an adjusting nut 48 which engages the stop 48' under the weight of the frame 42. By adjusting the adjusting nut 48, the adjusting member 45 and thereby the frame 42 are displaced toward or away from the rotary impact mechanism 3.

As illustrated in FIG. 1, the adjusting means may be provided only on the rear end of the second comminuting grate 15, as viewed in the direction of rotation 7, on the opposite sides of the frame 42 in connection with the respective side walls 27 and 28 of the container 2.

In the modified embodiment as illustrated in FIG. 10, the frame 42 is provided on the front end, as viewed in the rotational direction 7, with upwardly extending guide means 44 protruding toward the first comminuting grate 14 and tapering toward the same. There is thus formed a smooth transition between the two comminuting grates 14 and 15 for the material to be comminuted and which material is driven by the rotating flails 5 of the rotary impact mechanism 3. In this construction, the aforedescribed adjusting means are also provided on the front end of the second comminuting grate 15 and these adjusting means likewise contain the adjusting members 45 in order to permit vertical adjustment of the second comminuting grate 15 relative to the rotary impact mechanism 3.

Generally, the further comminuted material issues from the second comminuting grate 15 and falls to the ground to form a bottom layer of e.g. composting material. If desired, however, the comminuting machine 1 may be provided with conventional conveyor means (not shown) attached thereto in conventional manner so as to receive the further comminuted material passing through the second comminuting grate 15 and convey the same transversely or lengthwisely, as the case may be, with respect to the comminuting machine 1.

The arcuate plates 24 and 43 of the respective first and second comminuting grates 14 and 15 are respectively illustrated in FIGS. 4,6 and 11,12. These arcuate plates essentially have the same structure; this structure, therefore, is now commonly described hereinafter.

The arcuate plate 24,43 defines a multitude of throughpass openings 49 distributed across the arcuate plate 24,43, in the illustrated embodiment substantially in parallel, transverse rows. The illustrated throughpass openings 49 have a substantially rectangular shape, however, may assume any other shape appropriate for achieving the desired comminution. In particular, the throughpass openings 49 are configured to cause the desired further comminution. To this end, the throughpass openings 49 do not extend perpendicularly or in radial direction through the arcuate plate 24,43 but, with respect to the rotational direction of 7 of the rotary impact mechanism 3, at a larger angle in the range of 100° to 120°, preferably in the range of about 110°. This will be recognized in the sectional illustrations of FIGS. 7 and 11. As a result of such configuration, the rear edge 51 of the throughpass openings 49, as viewed in the rotational direction 7 of the rotary impact mechanism 3, defines a relatively sharp, ridge-shaped edge facing the material to be comminuted and which material is driven by the rotating flails 5 of the rotary impact mechanism 3 and forced through the throughpass openings 49. This ridge-shaped edge 51 thus acts on the advancing material in a breaking or crushing and, maybe, shearing manner and thus causes the desired further comminution.

Figure 6:
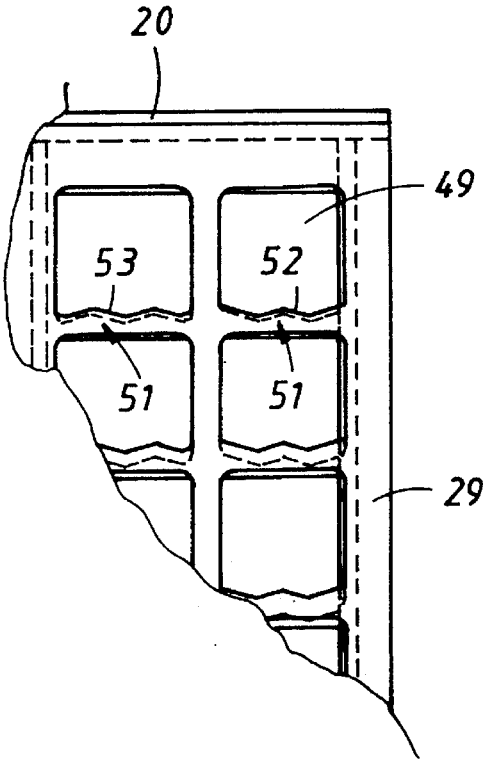
FIG. 6 is a top plan view of part of the first comminuting grate in the comminuting machine as shown in FIG. 1.

The further comminution can be additionally assisted by providing the ridge-shaped edge 51 with a profile 52 or 53 which protrudes into the interior of the throughpass opening 49. FIG. 6 shows both of these profiles in adjacent throughpass openings 49, however, as shown in FIG. 13, all of the ridge-shaped edges 51 may be provided with one and the same profile 52 or 53, as the case may be. The configuration of the profile 52 is such that the ridge-shaped edge 51 is formed with recesses which extend from the adjacent opposite sides of the throughpass openening 49, and a protrusion located between the recesses. The profile 53 is configured such that the ridge-shaped edge is formed with protrusions which extend from the adjacent opposite sides of the throughpass opening 49, and a recess located between the protrusions.

It should be noted that the first comminuting grate 14 is mounted at the comminuting machine 1 by linking the same in conventional manner to the protruding ends of the carriers 21 which extend from the impact plate 10. Such conventional linking connection can be readily disengaged and thus permits the first comminuting grate 14 to be exchanged for a comminuting grate of different comminuting action by, for example, differently dimensioned throughpass openings 49. Likewise, the second comminuting grate 15 is mounted at the container rear part 2 by nut-and-bolt means which are readily disengaged and thus permit the second comminuting grate 15 to be exchanged for a comminuting grate of different comminuting action by, for example, differently dimensioned throughpass openings 49.

Like the initially mentioned mobile comminuting machines, the inventive comminuting machine may also be equipped with the known overload coupling and/or overload control means which respond to an overload at the rotary impact mechanism. As explained hereinbefore, such overload coupling mainly acts to dampen rapid transient variations in the rotational speed of the rotary impact mechanism and prevents the same from affecting the prime mover whereas the overload control means react to the overload by decelerating and eventually stopping the infeed drive means driving the infeed means to convey the infed material to the rotary impact mechanism.

While there are shown and described present preferred embodiments of the invention, it is to be distinctly understood that the invention is not limited thereto, but may be otherwise variously embodied and practiced within the the scope of the following claims.

What I claim is:

1. A comminuting machine comprising:

a housing for receiving material to be comminuted;

a rotary impact mechanism disposed in said housing and defining a rotational direction;

an impact plate arranged in said housing and extending above a top portion of said rotary impact mechanism substantially in said rotational direction for cooperation with said rotary impact mechanism;

further comminuting means following said impact plate in said rotational direction;

said further comminuting means comprising at least one comminuting grate;

said at least one comminuting grate containing an arcuate plate perforated by a multitude of substantially rectangular throughpass openings distributed across said arcuate plate;

each one of said throughpass openings defining a rear edge as viewed in said rotational direction;

said rear edge having a profile comprising protruding and receding portions facing said rotational direction; and said at least one comminuting grate being exchangeably arranged at said housing.

2. The comminuting machine as defined in claim 1, wherein:

said throughpass openings extend through said arcuate plate at an angle different from a direction normal to said arcuate plate.

3. The comminuting machine as defined in claim 2, wherein:

said throughpass openings extend through said arcuate plate at an angle in the range of 100° to 120° as viewed in said rotational direction; and said rear edge constituting a ridge-shaped edge.

4. The comminuting machine as defined in claim 1, wherein:

said comminuting machine constitutes a waste wood comminuting machine;

a container for receiving waste wood to be comminuted;

a wheel-supported support frame carrying said container and defining a travel direction of said comminuting machine;

said container having a rear part with respect to said travel direction, said rear part constituting said housing; and said rotary impact mechanism being accommodated in said rear part of said container.

5. The comminuting machine as defined in claim 3, wherein said profile of said ridge-shaped edge comprises two protrusions and a recess therebetween.

6. The comminuting machine as defined in claim 3, wherein said profile of said ridge-shaped edge comprises a substantially central protrusion and recesses on both sides of said substantially central protrusion.

7. The comminuting machine as defined in claim 1, wherein:

said arcuate plate is located at a close radial spacing from said substantially cylindrical area of action of said rotary impact mechanism; and said arcuate plate extending along a predetermined arc along said substantially cylindrical area of action.

8. The comminuting machine as defined in claim 7, wherein:

said impact plate, which extends above said top portion of said rotary impact mechanism, has a general arcuate shape;

said impact plate having a rear end as viewed in said rotational direction of said rotary impact mechanism;

said arcuate plate having a front end as viewed in said rotational direction of said rotary impact mechanism; and said front end of said arcuate plate closely following said rear end of said impact plate as viewed in said rotational direction of said rotary impact mechanism.

9. The comminuting machine as defined in claim 8, wherein:

said impact plate has an inner side facing said rotary impact mechanism;

a plural number of substantially parallel rows of teeth protruding from said inner side of said impact plate in a direction opposing said rotational direction of said rotary impact mechanism;

said plural number of substantially parallel rows of teeth extending substantially transversely with respect to said rotational direction of said rotary impact mechanism;

said substantially transverse, substantially parallel rows of teeth being substantially transversely offset from each other;

said impact plate defining a lengthwise direction extending substantially parallel to said rotational direction of said rotary impact mechanism; and said teeth in said substantially transverse rows of teeth being out of alignment with each other in said lengthwise direction of said impact plate.

10. The comminuting machine as defined in claim 7, wherein:

said at least one comminuting grate comprises two comminuting grates respectively containing first and second arcuate plates;

said first arcuate plate being arranged on one side laterally of said rotary impact mechanism;

said second arcuate plate being disposed below said rotary impact mechanism; and said second arcuate plate immediately adjoining said arcuate plate as viewed in said rotational direction of said rotary impact mechanism.

11. The comminuting machine as defined in claim 10, wherein:

said multitude of throughpass openings being arranged in substantially parallel rows of said first and second arcuate plates; and said substantially parallel rows of throughpass openings in said second arcuate plate being substantially transversely offset from said substantially parallel rows of throughpass openings in said first arcuate plate.

12. The comminuting machine as defined in claim 10, wherein:

said impact plate defines a rear end as viewed in said rotational direction of said rotary impact mechanism;

said first arcuate plate defining a front end and a rear end as viewed in said rotational direction of said rotary mechanism;

said front end of said first arcuate plate being connected to said rear end of said impact plate; and said rear end of said first arcuate plate being supported at said housing.

13. The comminuting machine as defined in claim 12, further including:

a plural number of link members fixedly connected to said front end of said first arcuate plate;

a plural number of carriers mounted at said impact plate and extending to said first arcuate plate;

said plural number of link members being linked to respective ones of said plural number of carriers;

said first arcuate plate having an outer side and a plural number of supports fixedly connected thereto; and said plural numbers of supports supporting said rear end of said first arcuate plate at said housing.

14. The comminuting machine as defined in claim 10, further including adjusting means for adjusting said first arcuate plate in a direction toward and away from said rotary impact mechanism at both ends of said first arcuate plate as viewed in said rotational direction.

15. The comminuting machine as defined in claim 14, wherein:

said first arcuate plate defines a front end as viewed in said rotational direction of said rotary impact mechanism;

a plural number of link members fixedly connected to said front end of said first arcuate plate;

at least two of said plural number of link members being provided with respective ones of at least two holders;

said adjusting means including at least two adjusting members connected with respective ones of said at least two holders provided at said at least two link members;

a plural number of carriers mounted at said impact plate and extending to said first arcuate plate;

at least two of said carriers being associated with said at least two link members;

respective stops being provided at said at least two carriers; and said at least two adjusting members being adjustable relative to respective ones of said stops at said at least two carriers for adjusting said front end of said first arcuate plate in a direction toward and away from said rotary impact mechanism.

16. The comminuting machine as defined in claim 15, wherein:

said first arcuate plate defines a rear end as viewed in said rotational direction of said rotary impact mechanism;

said adjusting means including adjusting members for adjusting said rear end of said first arcuate plate toward and away from said rotary impact mechanism;

said first arcuate plate having an outer side and a plural number of supports fixedly connected thereto;

said housing being provided with a rest for resting said plural number of supports at said rear end of said first arcuate plate; and said adjusting members being connected with said plural number of supports and being adjustable relative to said rest in order to thereby adjust said rear end of said first arcuate plate in a direction toward and away from said rotary impact mechanism.

17. The comminuting machine as defined in claim 10, further including:

displacing means provided at said impact plate and connected to said first arcuate plate for displacing said first arcuate plate from an operative position to an inoperative position spaced from said area of action defined by said rotary impact mechanism.

18. The comminuting machine as defined in claim 17, wherein:

said displacing means include pressure fluid operated displacing means;

said pressure fluid operated displacing means including at least one hydraulic piston-cylinder unit linked to said impact plate on an outer side thereof;

said first arcuate plate having a front end as viewed in said rotational direction of said rotary impact mechanism;

said at least one hydraulic piston-cylinder unit containing at least one piston rod linked to said front end of said first arcuate plate.

19. The comminuting machine as defined in claim 17, further including hold-and-release means associated with said first arcuate plate; and said hold-and-release means being coupled to said displacing means.

20. The comminuting machine as defined in claim 19, wherein:

said housing has two opposite side walls;

said first arcuate plate having an outer side and two supports fixedly connected thereto and facing respective ones of said opposite side walls of said housing;

said hold-and-release means including:

holding pins mounted at two supports and extending toward respective ones of said opposite side walls of said housing;

hook-shaped members located at said opposite side walls of said housing for cooperation with said holding pins; and moving means connected to said hook-shaped members for holding said holding pins and thereby said first arcuate plate in an operative position thereof and for assisting release of said first arcuate plate from said operative position.

21. The comminuting machine as defined in claim 20, wherein:

said moving means for moving said hook-shaped members constitute pressure fluid operated moving means;

crank arms linked to said pressure fluid operated moving means; and crank shafts interconnecting said crank arms and said hook-shaped members.

22. The comminuting machine as defined in claim 21, further including:

pressure fluid operated displacing means linked to said impact plate on an outer side thereof;

said first arcuate plate defining a front end as viewed in said rotational direction of said rotary impact mechanism;

said pressure fluid operated displacing means being linked to said front end of said first arcuate plate for displacing the same from an operative position to an inoperative position spaced from said area of action of said rotary impact mechanism; and pressure fluid operated control means coupling said pressure fluid operated displacing means and said pressure fluid operated moving means of said hold-and-release means.

23. The comminuting machine as defined in claim 22, wherein:

said pressure fluid operated displacing means comprise at least one double acting hydraulic cylinder having a first portion and a second portion;

said pressure fluid operated moving means comprising a double acting hydraulic cylinder located on each one of said opposite side walls of said housing and having a first portion and a second portion;

an oil reservoir containing hydraulic oil;

a pump having an input side connected to said oil reservoir;

a 4/3-way valve connected to an output side of said pump and to said reservoir;

a first conduit extending from said 4/3-way valve to said first portion of said at least one double acting hydraulic cylinder of said pressure fluid operated displacing means and having a branch line connected to said section portion of said double acting hydraulic cylinder of said pressure fluid operated moving means on each one of said opposite side walls of said housing;

a second conduit extending from said 4/3-way valve to said second portion of said at least one double acting hydraulic cylinder of said pressure fluid operated displacing means and having a branch line connected to said first portion of said double acting hydraulic cylinder of said pressure fluid operated moving means on each one of said opposite side walls of said housing;

said 4/3-way valve assuming a first position in which said pump and said oil reservoir are interconnected through said 4/3-way valve;

said 4/3-way valve assuming a second position in which said pump is connected through said second conduit to said second portion of said double acting hydraulic cylinder associated with said pressure fluid operated displacing means and to said first portion of said double acting cylinder associated with said pressure fluid operated moving means while said oil reservoir is connected through said first conduit to said first portion of said double acting hydraulic cylinder associated with said pressure fluid operated displacing means and said second portion of said double acting hydraulic cylinder of said pressure fluid operated moving means, in order to pivot said first arcuate plate from said operative into said inoperative position; and said 4/3-way valve assuming a third position in which said pump is connected through said first conduit to said first portion of said double acting hydraulic cylinder associated with said pressure fluid operated displacing means and to said second portion of said double acting cylinder associated with said pressure fluid operated moving means while said oil reservoir is connected through said second conduit to said second portion of said double acting hydraulic cylinder associated with said pressure fluid operated displacing means and said first portion of said double acting hydraulic cylinder of said pressure fluid operated moving means, in order to pivot said first arcuate plate from said operative into said inoperative position.

24. The comminuting machine as defined in claim 23, further including a branch line leading from said second conduit to said oil reservoir through a pressure limiting valve.

25. The comminuting machine as defined in claim 10, further including means associated with said first arcuate plate for holding the same in an operative position; and said holding means comprising a rest provided at said housing, and supports provided at said first arcuate plate and engaging said rest in order to support said first arcuate plate at said rest in said operative position.

26. The comminuting machine as defined in claim 19, wherein:

said housing has opposite side walls;

said first arcuate plate having an outer side and a plural number of supports fixedly connected thereto;

said supports having lower ends;

said holding means including at least two substantially rectangular angle members located at said lower ends of respective ones of said supports;

said holding means further including a rest extending between said opposite side walls;

said rest having a substantially rectangular shape and being arranged with an upwardly directed corner portion;

said at least two substantially rectangular angle members being arranged substantially parallel to said rest; and said at least two substantially rectangular angle members having free ends located at lower level than said rest in said operative position of said first arcuate plate.

27. The comminuting machine as defined in claim 10, further including:

a frame holding said second arcuate plate and having opposite sides;

said housing having opposite side walls associated with said opposite sides of said frame; and said frame being releasably mounted at said opposite walls of said housing.

28. The comminuting machine as defined in claim 27, further including:

adjusting means for adjusting said second arcuate plate in a direction toward and away from said rotary impact mechanism;

said second arcuate plate defining a front end and a rear end as viewed in said rotational direction of said rotary impact mechanism; and said adjusted means being provided at least at said rear end of said second arcuate plate.

29. The comminuting machine as defined in claim 28, wherein:

said adjusting means comprise an adjusting member releasably connected to said second arcuate plate; and a stop provided at said housing and engaged by said adjusting member.

30. The comminuting machine as defined in claim 29, wherein:

said adjusting member contains a threaded portion and an associated adjusting nut;

said stop at said side wall of said housing being engaged by said adjusting nut; and said adjusting nut being adjustable in order to thereby adjust said second arcuate plate in said direction toward and away from said rotary impact mechanism.

31. The comminuting machine as defined in claim 28, wherein:

guide means provided at said front end of said second arcuate plate;

said first arcuate plate having a rear end as viewed in said rotational direction of said rotary impact mechanism;

said guide means extending toward said rear end of said first arcuate plate;

said adjusting means being provided at said front end as well as at said rear end of said second arcuate plate.

32. The comminuting machine as defined in claim 10, further including:

a cover plate defining opposite lateral sides;

a plural number of carriers mounted at said impact plate and extending to said first arcuate plate;

said carriers having free ends to which said cover plate is pivotably mounted;

said cover plate being pivotable between a first position in which the cover plate essentially covers the discharge side of said first arcuate plate, and a second position in which said cover plate is upwardly pivoted into an open position; and said cover plate, in said open position thereof, extending at a downwardly inclined position.

33. The machine as defined in claim 32, further including:

support members pivotably mounted at said opposite lateral sides of said cover plate;

each one of said support members defining a support edge;

said housing defining a discharge opening covered by said first arcuate plate;

said housing defining an outer side adjacent said discharge opening; and said support edge of said support members supporting said cover plate at said outer side of said housing in said upwardly pivoted position of said cover plate.

* * * * *